US006971422B2

(12) United States Patent
Chuang

(10) Patent No.: US 6,971,422 B2
(45) Date of Patent: Dec. 6, 2005

(54) LOCKING DEVICE FOR A PLANE MACHINE

(76) Inventor: Bor Yann Chuang, No. 78, Yungfeng Rd., Taiping Shiang, Taichung (TW) 411

( * ) Notice: Subject to any disclaimer, the term of this patent is extended or adjusted under 35 U.S.C. 154(b) by 71 days.

(21) Appl. No.: 10/629,791

(22) Filed: Jul. 30, 2003

(65) Prior Publication Data

US 2005/0022900 A1 Feb. 3, 2005

(51) Int. Cl.[7] ..... B27C 1/14
(52) U.S. Cl. ..... 144/130; 144/129; 144/117.1
(58) Field of Search ..... 144/114.1, 117.1, 144/121–123, 128–130, 368, 373; 409/180–182, 409/206, 210, 218; 30/476–478, 487

(56) References Cited

U.S. PATENT DOCUMENTS 5,829,499 A * 11/1998 Liao ..... 144/130
5,957,173 A * 9/1999 Garcia ..... 144/117.1
6,516,684 B1 * 2/2003 Chang ..... 74/579 R

* cited by examiner

*Primary Examiner*—Derris H. Banks
*Assistant Examiner*—Shelley Self
(74) *Attorney, Agent, or Firm*—Troxell Law Office, PLLC

(57) ABSTRACT

A locking device for a plane machine includes a handle, an actuating rod, two side bases, an urging block respectively provided at two sides of each side base. The actuating rod is urged by a spring to bias a bit to one side of a machine base of a plane machine when the locking device is in a normal not-locking positions with the handle being in a not-pushed position, and the machine base is not locked with four posts of the plane machine. When the handle is pressed inward to a locking position, the actuating rod is moved to force the two side bases move nearer the center of the machine base, forcing the four urging blocks to tightly pushing the four posts to lock the machine base at an adjusted position after the machine base is adjusted to a needed height by means of a rotating button and a threaded rod.

6 Claims, 7 Drawing Sheets

LOCKING DEVICE FOR A PLANE MACHINE

BACKGROUND OF THE INVENTION

1. Field of the Invention

This invention relates to a locking device for a plane machine, particularly to one locking a machine base with four posts of a plane machine.

2. Description of Prior Art

A conventional plane machine generally has a machine base moving up and down along posts, and in order to reinforce stability of the machine base, some plane machines have a locking device for locking the machine base with the posts after adjusted in its height, as disclosed in a U.S. Pat. No. 5,771,949 shown in FIGS. 1 and 2. It includes posts 1, a handle 2 provided between two posts 2. When the handle 2 is pressed down, a locking rod 3 and a length-changing rod 4 respectively positioned at the front and at the rear of the machine base are pressed down. The length-changing rod 4 consists of a first connect rod 5 and a second connect rod 6 inserted in a connect groove 7 of the first connect rod 5. The first connect rod 5 has a center slot 8 for receiving a spring 9, forcing the second connect rod 6 to be indirectly pushed by the spring 9. So when the handle 2 is pressed down, the locking rod 3 may force the second connect rod 6 move backward to compel the clamp firmly clamp the post 1.

However, the conventional plane machine has too many components to form a very complicated structure, demanding comparatively high precision, taking much time in assembling, difficult to obtain expected effect.

SUMMARY OF THE INVENTION

This invention has been devised to offer a locking device for a plane machine, which includes a handle to move an actuating rod to move lengthwise in line on a machine base, then moving inward two side bases limitedly positioned at two sides of the machine base. Then an urging block respectively fixed at two sides of each side base clamp tightly each of four posts so that the machine base may be firmly locked with the posts, after adjusted in its height.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
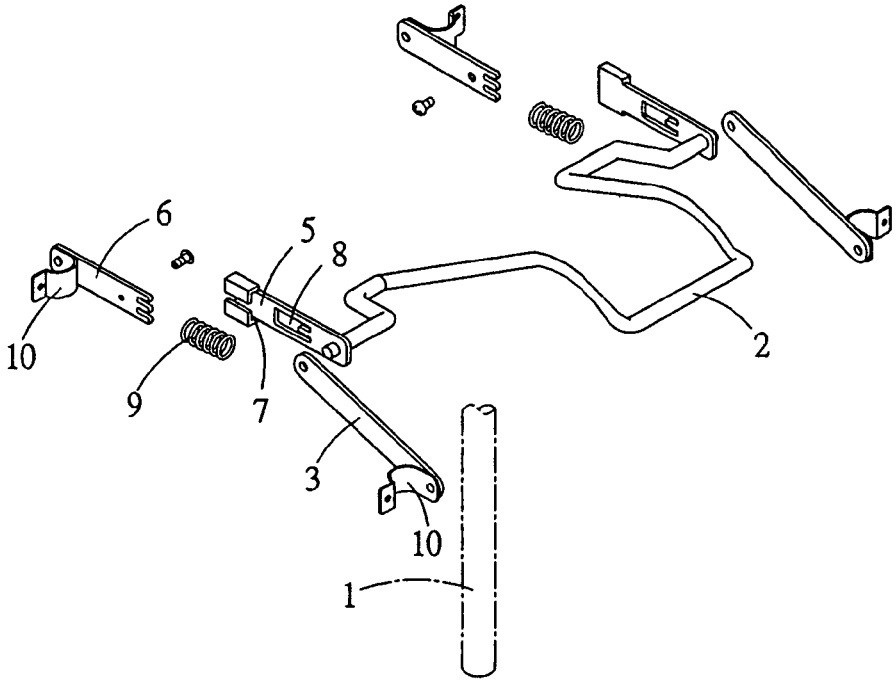
FIG. 1 PRIOR ART
FIG. 1 is an exploded perspective view of a locking device of a conventional plane machine.
Figure 2:
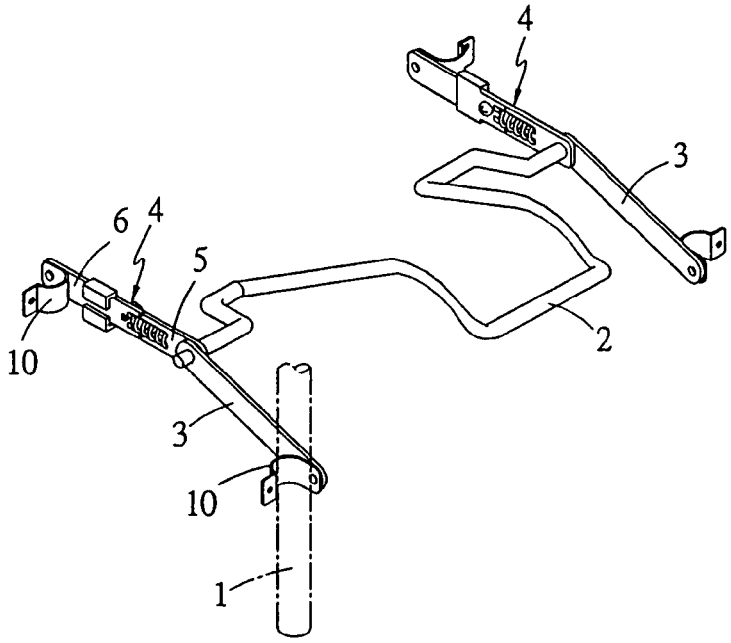
FIG. 2 PRIOR ART
FIG. 2 is a perspective view of the locking device of a conventional plane machine.
Figure 3:
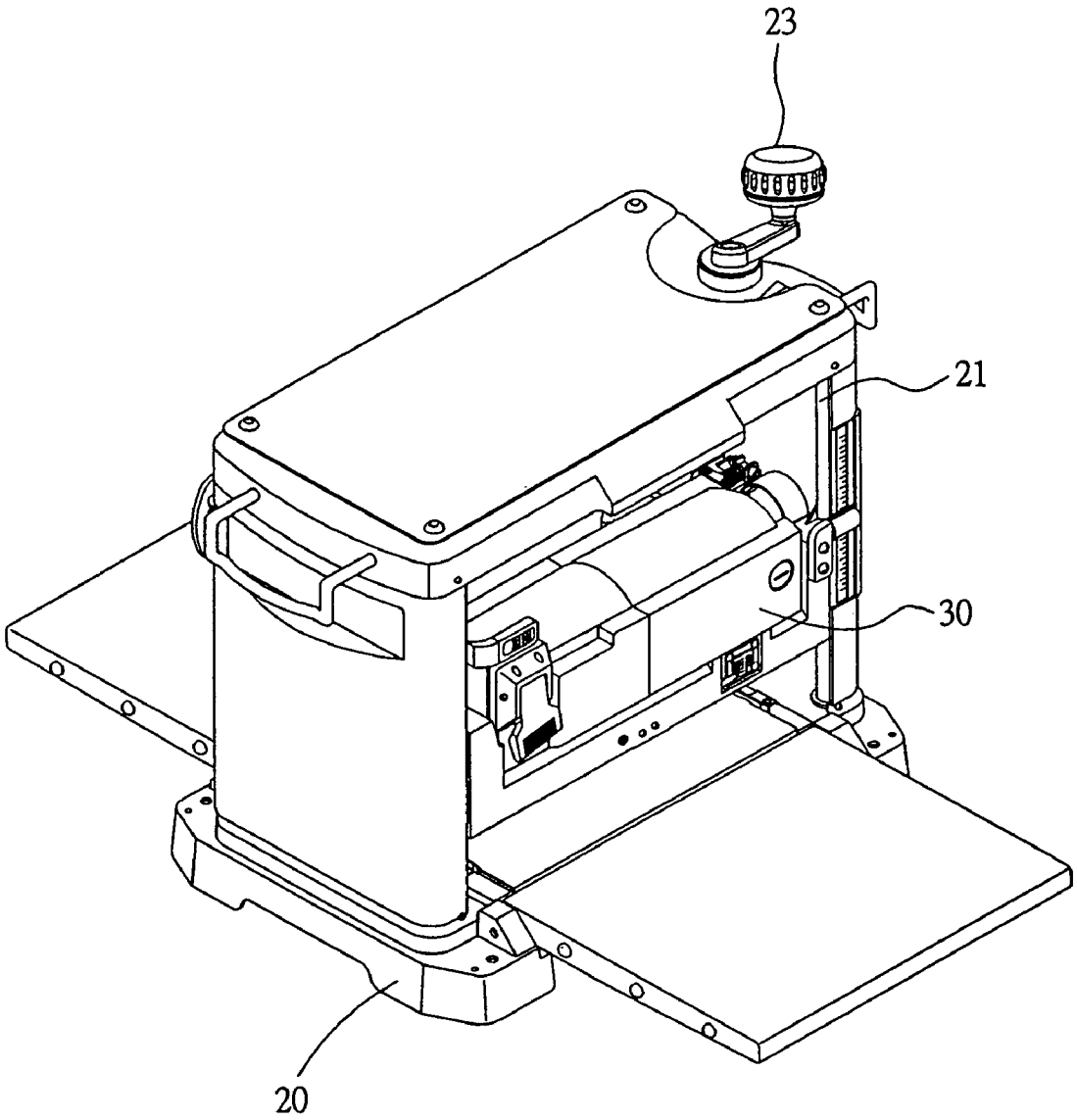
FIG. 3 is a perspective view of a plane machine having a locking device in the present invention.
Figure 4:
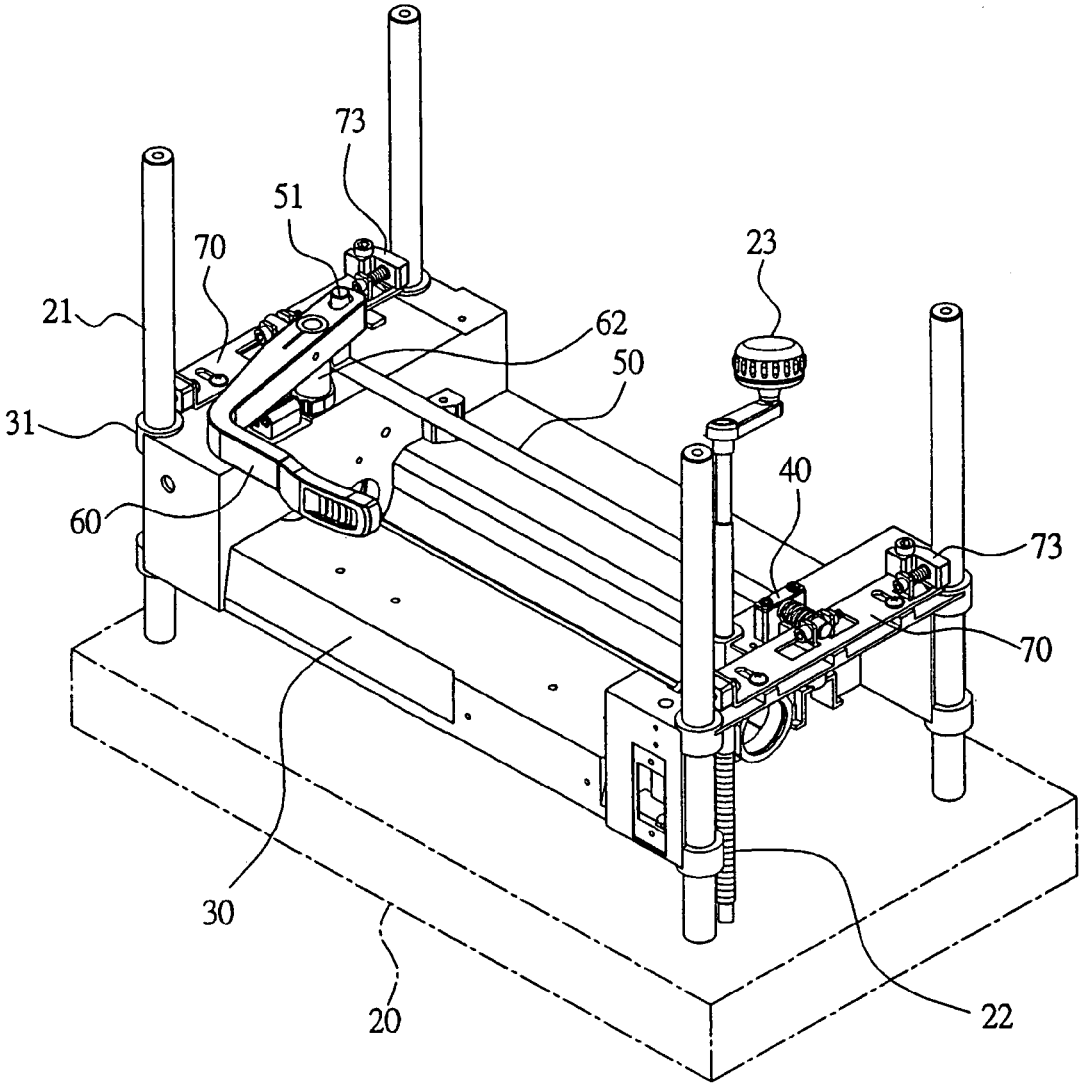
FIG. 4 is a partial perspective view of the plane machine with the locking device in the present invention.
Figure 5:
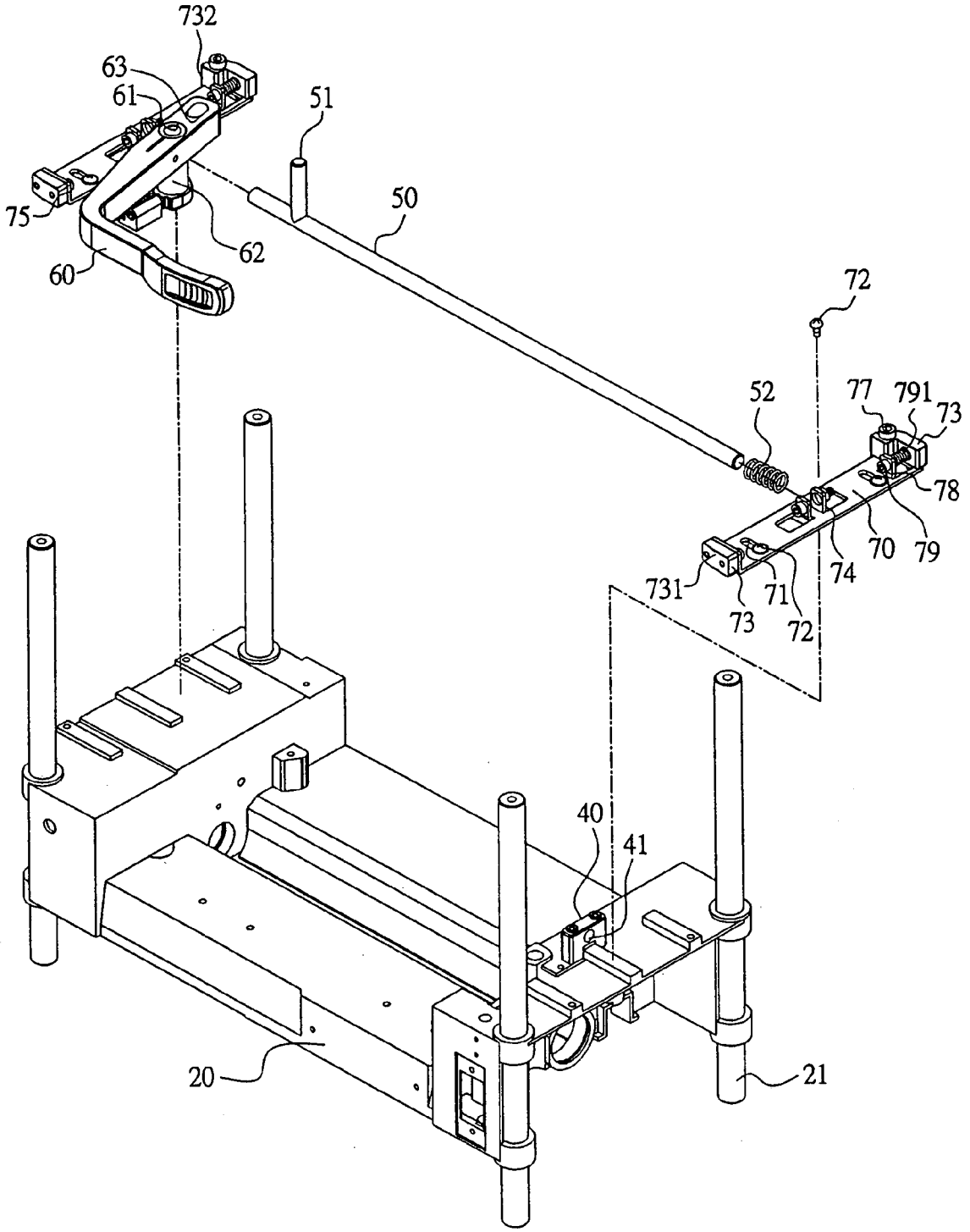
FIG. 5 is a partial exploded perspective view of the locking device in the present invention.
Figure 6:
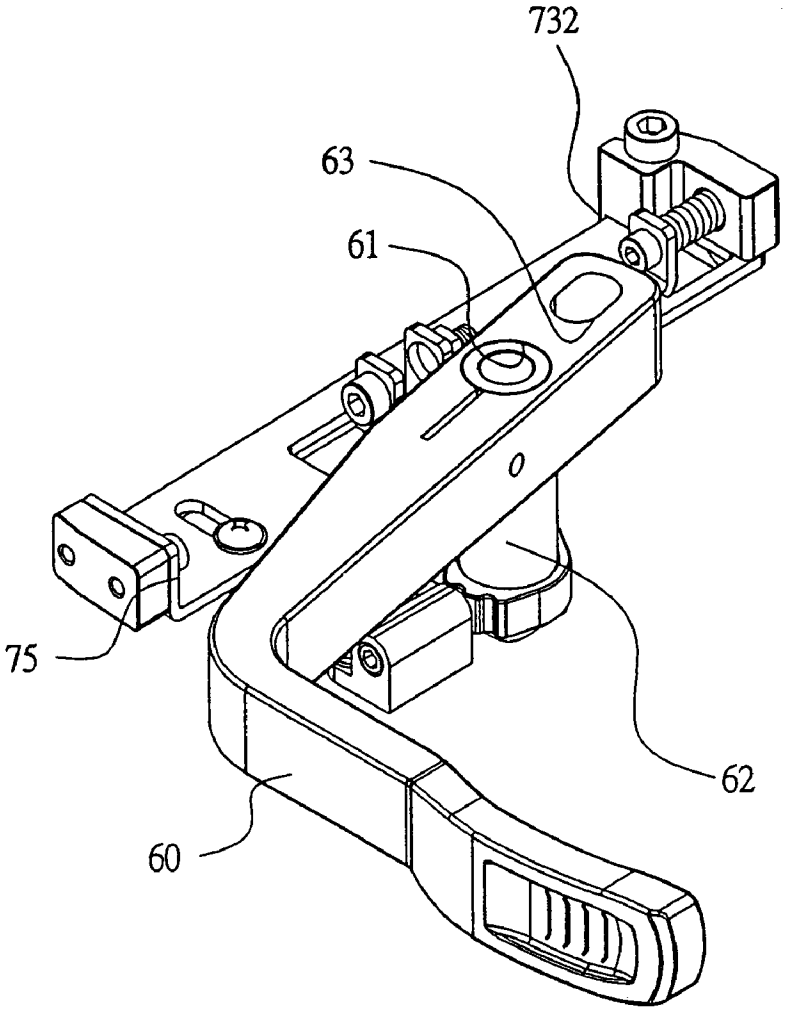
FIG. 6 is a partial enlarged perspective view of the locking device in the present invention.

A preferred embodiment of a locking device for a plane machine in the present invention, as shown in FIGS. 3, 4 and 5 is combined with a plane machine, which includes a bottom base 20, four posts positioned respectively at four corners of the bottom base 20, a machine base 30 connected with the four posts 21 by means of a ring 31, a moving rod 22 threadably connected with the center portion of two sides of the machine base 30, a rotating button 23 to control a threaded rod 22 in upright movement. Those components are the same as the convention art, not to be described. The important improvement of the invention is the components described below.

A locking device to be provided on the machine base 30 includes two rod bases 40, an actuating rod 50, a handle 60, and two side bases 70.

The two rod bases 40 are respectively fixed on the upper surface of two sides of the machine base 20, having a shaft hole 41 for the actuating rod 50.

The actuating rod 50 has two ends respectively fitting in the shaft holes 41 of the two rod bases 40, an insert rod 51 fixed upright on the left end, and a spring 52 fitting around the right end.

The handle 60 is L-shaped, having a shaft hole 61 in one end for a pivotal shaft 62 to fit therein and also to extend pivotally in an upper surface of the left side of the machine base 30, a rectangular groove 63 formed in an outer end near the shaft hole 61 for the insert rod 51 to fit therein. Then the handle 60 can move the actuating rod 50 lengthwise when it is pushed inward from a normal position to a locking position.

The two side bases 70 are shaped as an elongate plate, respectively positioned on the upper surface of the two sides of the machine base 30, having a limit slot 71 respectively yin two sides for a limit screw 72 to screw with and also with the machine base 30. Each side base 70 further has an urging block 73 respectively at two sides, and each urging block 73 has a vertical urging surface 731, with the distance between two of the urging surfaces 731 being a little larger than the distance between the two posts 21. Further, each side base 70 has a pair of pivotal studs 74 to pivotally connect with the two ends of the actuating rod 50, and at the same time the two ends of the spring 52 held at the right end of the actuating rod 50 between the outer edge of the rod base 40 and the pivotal stud 74. Then the rod base 40 is a bit biased to the right side of the machine base 30 by the elasticity of the spring 52 when the locking device in the normal condition, with the handle 60 being in not pressed inward. That is, the machine base is not locked with the posts 21. But when the machine base is wanted to be locked with the posts 21 after adjusted in its height, the handle 60 is pushed inward moving the actuating rod to force the two side bases 70 move nearer to the center of the machine base 30 resisting the elasticity of the spring 52, and subsequently the urging surface of the four urging blocks 73 compress respectively the inner wall of the four posts 21, in case the handle 60 is pressed inward to a locking position. Thus the machine base 50 is locked with the four posts 21.

Next, the two urging blocks 73 positioned on each side base 70 may be made with one being stationary and the other being rotatable pivotally. The stationary urging block is then locked with the outer wall of a plate 75 extending up from one side of each side base 70 by means of a screw 76. And the rotatable urging block is pivotally connected with the other side of each side base 70 by means of a pivot 77. Further, a stud 78 is provided upward at the other side of the side base 70, and a screw 79 with a buffer spring 791 is fitted around pivotally connected with the stud 78 so the buffer spring 791 compresses the urging block 73 to move farther away from one end of the pivotal point. Then the urging block 73 may extend downward to rest on a stop 732 at the side edge of the side base 70. Thus when the urging block 73 is compressed by the buffer spring 791, the urging block 73 is prevented from rotating outward by the stop 732. When the urging block 73 presses tightly each post 21, the buffer spring 791 may buffer the pressure. Further, in order to facilitate the urging block 73 to press smoothly each posts 21, the urging block 73 has its front portion of the outer wall shaped with a proper slope to contact each post 21 so as to let each post 21 gradually contact with the urging surface 731 of the urging block 73.

Figure 7:
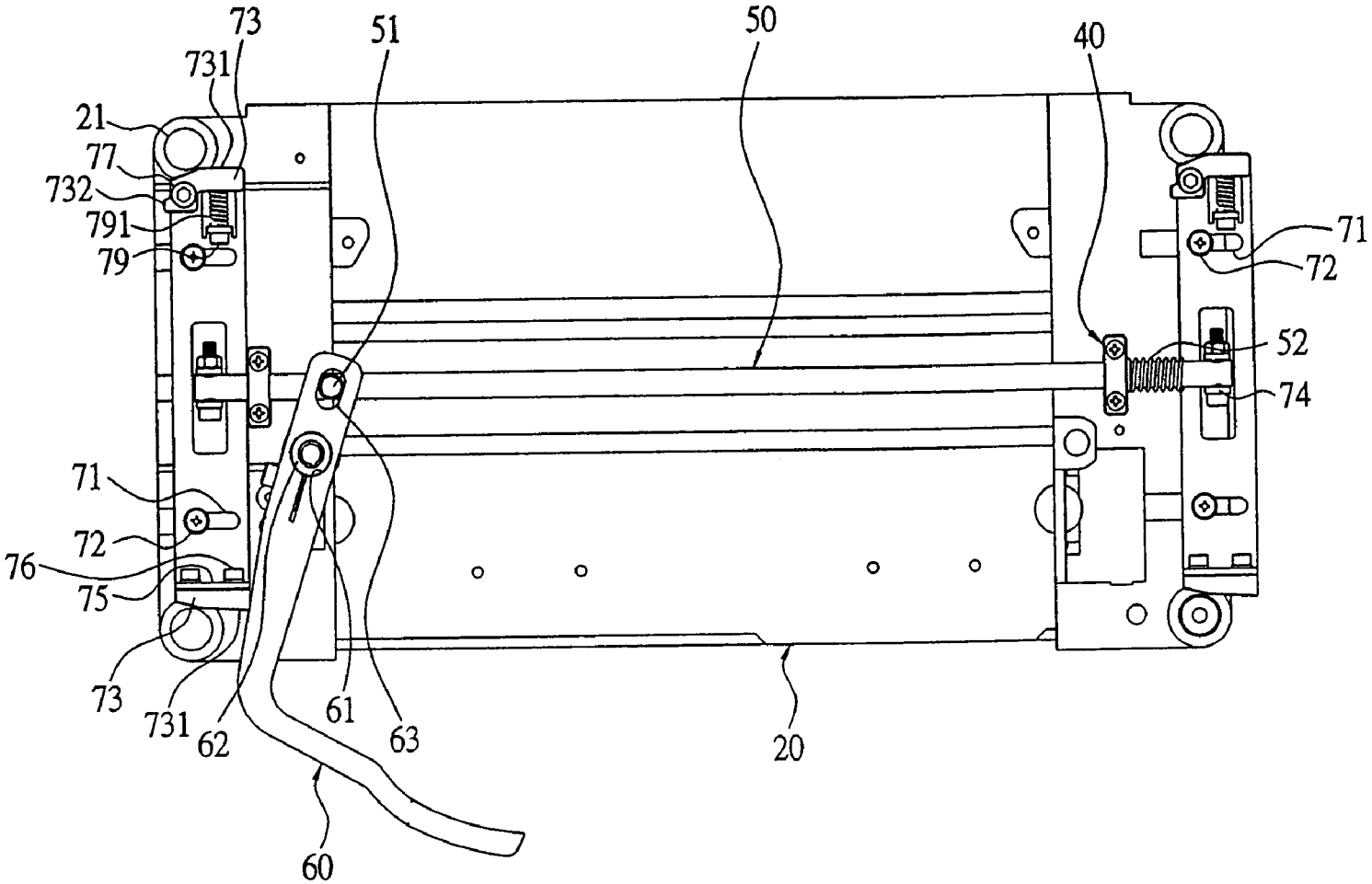
FIG. 7 is an upper view of the locking device in a loose condition in the present invention; and, FIG. 8 is an upper view of the locking device in a tightly locked condition in the present invention.
Figure 8:
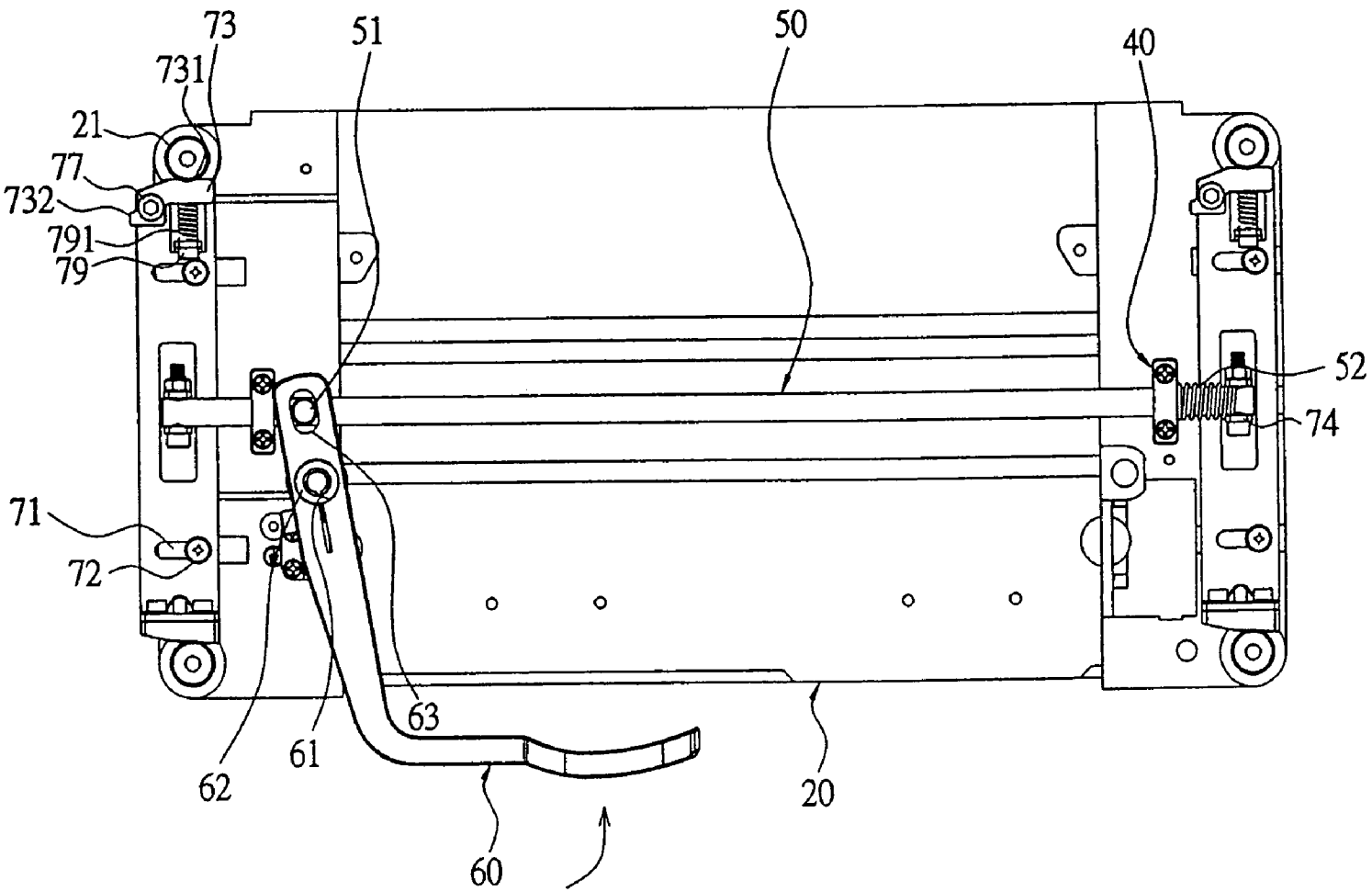

Next, as shown in FIGS. 7 and 8, the function of the locking device is to be described. When the machine base 30 is not yet locked in the normal position, the handle 60 of the locking device is in a loose not-locking position, with the right one of the two side bases 70 actuated by the actuating rod 50 urged by the elasticity of the spring 52 to bias to the machine base 30. And the two urging blocks 73 of the right side base 70 are positioned at an outer side of two posts 21, and the two urging blocks 73 on the left side base 70 are positioned at an inner side of the other two posts 21, in the separated condition without contacting with one another.

If the machine base 30 is wanted to be locked after adjusted in its position, the handle 60 is pushed inward to a locking position, letting the insert rod 51 move the actuating rod 50 and then the two side bases 70 nearer to the center of the machine base 30, with the two pairs of the urging blocks 73 respectively pressing from the outside and from the inside to the posts 21 so as to lock the machine base 30 with the four posts 21.

On the contrary, if the machine base 30 is wanted to be released from the posts 21, repeating reversely the locking process can attain the purpose, with the spring 52 combined at the right end of the actuating rod 50 recovers its elasticity to push back the side bases 78 to its biased position. So the locking device is easy to operate.

While the preferred embodiment of the invention has been described above, it will be recognized and understood that various modifications may be made therein and the appended claims are intended to cover all such modifications that may fall within the spirit and scope of the invention.

What is claimed is:

1. A locking device for a plane machine comprising:

a) a bottom base having:

i) four posts, one of the four posts being connected to one of four corners of the base; and ii) a threaded rod connected to the bottom base at a first end thereof and having a rotating button fixedly connected to a second end thereof;

b) a machine base having four rings, one of the four posts being inserted through each of the four rings, a center of the threaded rod being adjustably connected to a lateral side of the machine base;

c) first and second rod bases, the first rod base being connected to a first end of the machine base, the second rod base being connected to a second end of the machine base;

d) an actuating rod inserted through a shaft hole of each of the first and second rod bases and having an insert rod protruding upwardly from a first end thereof;

e) an L-shaped handle pivotally connected at a first end thereof to a first end of the machine base and having a rectangular hole located on the first end, and a second end movable between unlocked and locked positions, the insert rod is inserted into the rectangular hole; and f) first and second side bases, the first side base is slidably connected to the first end of the machine base, the second side base is slidably connected to the second end of the machine base, each of the first and second side bases having two urging blocks located between and selectively engaging two posts of the four posts, wherein, when the second end L-shaped handle is in the unlocked position, the L-shaped handle moves the actuating rod and the first and second side bases toward the second end of the machine base, the two urging blocks of each of the first and second side bases are disengaged from the four posts, the machine base is adjustable upwardly and downwardly to a selected position by turning the threaded rod, and, when the second end L-shaped handle is in the locked position, the L-shaped handle moves the actuating rod and the first and second side bases toward the first end of the machine base, the two urging blocks of each of the first and second side bases are engaged with the four posts, the machine base is locked in the selected position.

2. The locking device according to claim 1, further comprising a spring located on the second end of the actuating rod between the second rod base and the second side base, the spring pressing against the second rod base and the second side base at opposing ends thereof.

3. The locking device according to claim 1, further comprising a plurality of screws, each of the first and second side bases having two limit slots spaced apart, one of the plurality of screws being inserted through each of the two limit slot and connected to the machine base.

4. The locking device according to claim 1, wherein each of the first and second side bases having a pair of pivotal studs, the pair of pivotal studs of the first side base is pivotally connected to the first end of the actuating rod, and the pair of pivotal studs of the second side base is pivotally connected to a second end of the actuating rod.

5. The locking device according to claim 1, wherein the two urging blocks of each of the first and second side bases include a stationary urging block and an adjustable urging block, each of the first and second side bases includes a plate fixedly connected to the stationary urging block, a pivot pivotally connected to the adjustable urging block, a stop limiting a pivotal movement of the adjustable urging block, and a buffer spring located between the adjustable urging block and a stud buffering a pressure thereof.

6. The locking device according to claim 1, wherein each of the two urging blocks of each of the first and second side bases having a vertical urging surface having a sloped edge guiding each of the four posts against the vertical urging surface.

* * * * *